United States Patent [19]

Stock

[11] Patent Number: 4,498,609

[45] Date of Patent: Feb. 12, 1985

[54] DROPPER FOR CYANOACRYLATE ADHESIVES

[75] Inventor: Hugh J. Stock, Saratoga, Calif.

[73] Assignee: Pacer Technology and Resources, Inc., Campbell, Calif.

[21] Appl. No.: 107,334

[22] Filed: Dec. 26, 1979

Related U.S. Application Data

[63] Continuation-in-part of Ser. No. 69,748, Aug. 27, 1979.

[51] Int. Cl.[3] ..... B65B 47/18

[52] U.S. Cl. ..... 222/420; 222/567; 222/571

[58] Field of Search ..... 222/420, 567, 568, 570, 222/571; 73/425, 4 P

[56] References Cited

U.S. PATENT DOCUMENTS 2,811,283 10/1957 Bowen ..... 222/420 X
3,266,682 8/1966 Schultz ..... 222/570
4,138,040 2/1979 Stock ..... 222/420

FOREIGN PATENT DOCUMENTS 2355057 5/1975 Fed. Rep. of Germany ..... 222/420
2443382 6/1975 Fed. Rep. of Germany ..... 222/567

*Primary Examiner*—David A. Scherbel
*Attorney, Agent, or Firm*—Cahill, Sutton & Thomas

[57] ABSTRACT

A dropper, press fitted into the neck of a cyanoacrylate adhesive dispensing container, includes an elongated nozzle having a constant diameter passageway. The inlet to the nozzle is defined by a downwardly depending hollow boss having a sharp edged perimeter and sharp edged orifice. The sharp edged orifice and sharp edged perimeter tend to discourage retention of any droplets of cyanoacrylate adhesive to maintain the inlet free of residual cyanoacrylate adhesive and free of the crusting and clogging of the inlet which might otherwise occur.

3 Claims, 2 Drawing Figures

DROPPER FOR CYANOACRYLATE ADHESIVES

Figure 1:
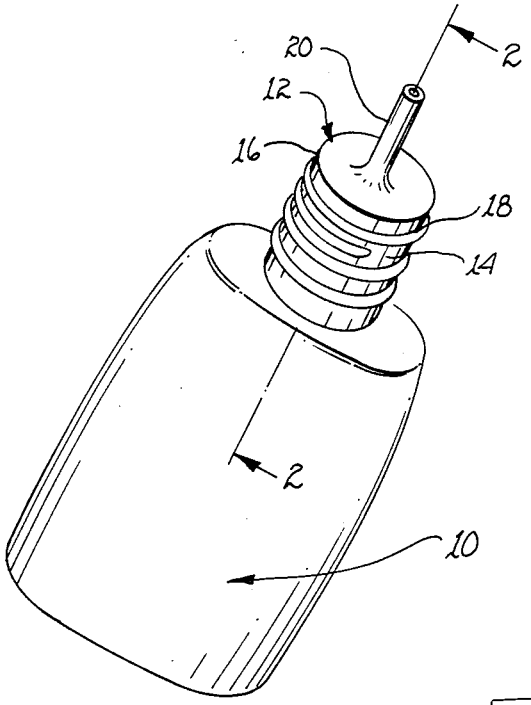

The present application is a continuation-in-part application of a copending application entitled "DROPPER FOR CYANOACRYLATE ADHESIVES", assigned Ser. No. 69,748, filed on Aug. 27, 1979, and describing an invention by the present inventor and assigned to the present assignee.

The present invention relates to containers for adhesives and, more particularly, to droppers for cyanoacrylate adhesives.

Droppers for various types of adhesives are well known. Primarily, these droppers include a tip having a tappered internal passageway terminating at a reduced diameter outlet. Should the tip or the passageway become clogged by the drying or curing of the adhesive, dislodgement of the dried or cured adhesive is generally effected by ramming the dried or cured adhesive with a pin or the like. In other prior art droppers, the tip is sufficiently flexible to cause dislodgement by flexing of the nozzle with or without the introduction of a ram into the passageway.

For a very small diameter nozzle which serially dispenses small quantities of adhesives, the internal passageway is too minute to employ a ram to clear it. Moreover, flexing of the nozzle may be ineffective to dislodge particles of dried or cured adhesives.

Generally, little consideration has been given to the configuration of the inlet to the dropper passageway which will avoid retention of residual adhesive that might clog the inlet. The configuration of the inlet, to effectively prevent adhesive retention, must be matched with both the viscosity and surface tension of each particular adhesive commensurate with the size of the passageway.

It is therefore a primary object of the present invention to provide a self-clearing dropper.

Another object of the present invention is to provide a self-clearing dropper for use with cyanoacrylate adhesives.

Yet another object of the present invention is to provide a self-clearing dropper for adhesives which cure by polymerization.

Still another object of the present invention is to provide a self-clearing dropper which discourages retention of a cyanoacrylate adhesive at the inlet of the dropper.

A further object of the present invention is to provide a dropper having a sharp edged inlet orifice to preclude depending attachment of a drop of cyanoacrylate adhesive.

A yet further object of the present invention is to provide a dropper having insufficient contact area at the inlet of a constant diameter passageway extending through the dropper to support by surface tension a drop of cyanoacrylate adhesive.

A still further object of the present invention is to provide a dropper having an hollow boss defining an inlet to a constant diameter passageway extending through the dropper and which boss includes a sharp edged orifice and a sharp edged perimeter to minimize support for retention by the effect of surface tension of droplets of a cyanoacrylate adhesive.

These and other objects of the present invention will become apparent to those skilled in the art as the description thereof proceeds.

Figure 2:
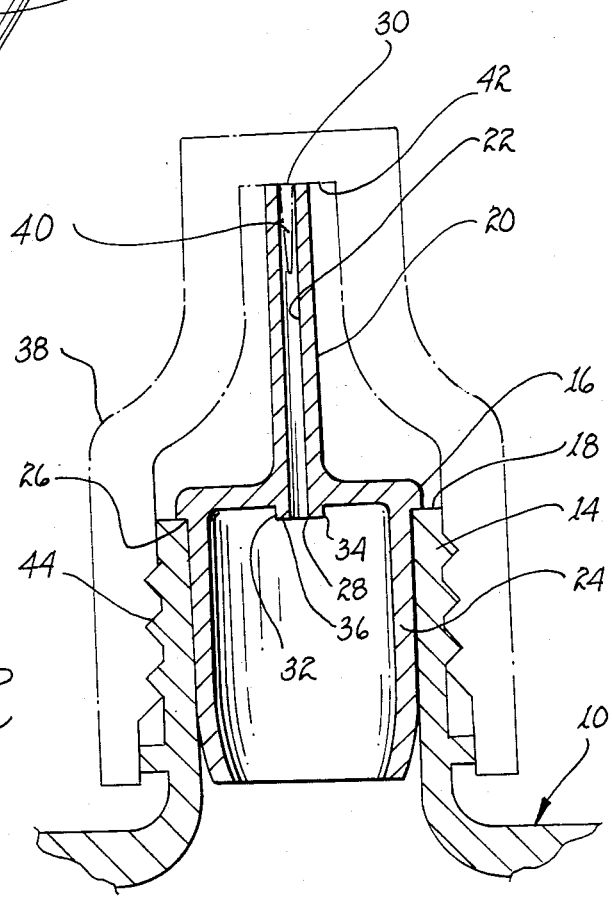

The present invention may be described with greater specificity and clarity with reference to the following drawings, in which:

FIG. 1 illustrates a dropper attached to a container for a liquid adhesive; and FIG. 2 is a cross-sectional view taken along lines 2—2, as shown in FIG. 1.

Referring to FIG. 1, there is shown a container 10 for containing an adhesive, such as a cyanoacrylate composition, which is to be dispensed through dropper 12. In the preferred embodiment, dropper 12 is retainingly lodged within neck 14 of container 10, but is may be externally fitted to the neck.

The dropper includes an annular flange 16 for contactingly mating with annular end surface 18 of neck 14 and thereby positionally locate the dropper with respect to the neck. A nozzle 20 extends outwardly from flange 16 and includes an internal passageway 22 for dispensing the adhesive contained within container 10. Retention of dropper 12 within neck 14 may be accomplished by a cylindrical skirt depending from annular flange 16, which skirt is press fit into the neck.

Prior art droppers may be externally quite similar to dropper 12 shown in FIGS. 1 and 2. That is, they may include an annular flange supporting a nozzle and a depending cylindrical skirt. Such prior art nozzles are characterized by a passageway internal to the nozzle which has a wide mouthed inlet. The passageway itself is generally tapered geometrically from the inlet to the outlet.

A tapered passageway presents several problems in maintaining the passageway cleared. After the adhesive container, to which the nozzle is secured, is placed in an upright position, the adhesive within the passageway will tend to gravitate downwardly and flow along the internal surface of the passageway. The substantial surface contact which is available between the flowing adhesive and the passageway tends to provide sufficient purchase to allow the surface tension attendant the flowing adhesive to support puddles or drops of adhesive proximate to the inlet to the passageway. Such puddles or drops may bridge across the passageway at any point therealong. If the size of the passageway is sufficiently large, any bridging can be dislodged by ramming an appropriate sized diameter rod through the passageway. Alternatively, if the adhesive, on drying or curing, forms a crystalline structure (crusting), and assuming that the nozzle is flexible, dislodgement of the adhesive may be effected by flexing the nozzle. However, nozzles having very small diameter passageways which cannot be rammed and which are too small to allow clearing of crusted adhesive by flexing are essentially useless. Such crusting will often occur with anaerobic and cyanoacrylate adhesives.

Moreover, the configuration of the inlet to the passageway may tend to promote retention of drops or droplets of adhesive on righting of the container. These drops or droplets, when fully or partially cured, have a tendency to immediately clog the inlet or provide a rapid build up of adhesive which will clog the inlet.

Turning now to FIG. 2, the structure of nozzle 12, which overcomes the problems attendant prior art nozzles, will be described. Nozzle 12 is positionally located within neck 14 of container 10 by cylindrical skirt 24 depending from annular flange 16 and defining, in combination with the annular flange, an annular shoulder 26 to bear against annular end surface 18. Retention of the nozzle in the neck is accomplished by a press fit.

Passageway 22 is of essentially constant diameter from inlet 28 to outlet 30. Contrary to expectations, essentially total drainage by the force of gravity of a cyanoacrylate adhesive will occur in a constant diameter passageway. To the extent presently understood, it is believed that this phenomenon is primarily a function of surface tension. Moreover, surface tension in combination with other parameters such as propensity for rapid polymerization, degree of surface energy of the material defining the passageway and the draining outlet will support continuing drainage. An initial flow through the passageway may be initiated by a plug, plunger or the like.

In one embodiment of the passageway, the actual diameter of the passageway may be made dependent, to some extent, upon the length of the passageway in order that the volumetric displacement of the passageway be commensurate with a multiple of the size of a drop of adhesive which is heavy enough not to be retainingly suspendable from either the outlet or the inlet of the passageway. With this embodiment, the likelihood of total evacuation is promoted as there exists a high probability that all adhesive within the passageway will develop into one or several drops that will disengage from the inlet and not leave any residual adhesive in the passageway or at the inlet.

By maintaining the orifices at both the inlet and the outlet very sharp edged, the surface area in contact with a drop of adhesive is maintained at a minimum. Such minimum contact area tends to minimize the droplet size, or weight, which is supportable by the inherent surface tension of the drop of adhesive. Accordingly, the drops from the passageway will not have sufficient purchase to be retained in suspension from either the outlet or the inlet.

As there may occur some flow of the cyanoacrylate adhesive lateral to the orifice before buildup of a drop, such flow is restrained through the use of a hollow boss 32 to define orifice 28. Perimeter 34 of the boss is sharp edged to constrain lateral flow to annular surface 36. Were any adhesive to flow to the perimeter, retention of any depending droplet thereat would be discouraged by the limited purchase available to the forces of the surface tension of the drop by sharp edged perimeter 34.

The operative results arising from the above described structure of nozzle 20 may be described as follows. After adhesive from within container 10 has been dispensed, the container is generally placed in an upright position. Any residual adhesive passageway 22 will gravitate toward inlet 28. Upon collecting at the inlet, the adhesive will form into a drop (or droplet). By maintaining a sharp edge at inlet orifice 28, the surface area of the inlet in contact with the drop can be maintained insufficient to permit the inherent surface tension of the drop from exerting a sufficient retentive force to suspend the drop from the inlet. Consequently, the drop or drops will fall back into the container. Thereby, passageway 22 is self-clearing each and every time container 10 is placed in the upright position.

By maintaining the orifice of outlet 30 sharp edged, accumulation of the adhesive about the end of nozzle 20 is generally limited because the sharp edge will tend to minimize flow of adhesive onto the end surface of the nozzle. Thereby, the possibility of crusting at outlet 30 is reduced. Even if such crusting does occur, it is readily removable as the outlet is readily accessible.

By experimentation, it has been learned that droppers, of the type depicted in FIGS. 1 and 2, are particularly useful in conjunction with the dispensation of cyanoacrylate and anaerobic adhesives. These adhesives are generally used to bond two close fitting and mated surfaces. Insertion of the adhesive intermediate the surfaces is effected by wicking, a natural characteristic of the adhesive. Since the wicking is generally extensive and of a thin film, very small drops or droplets are generally employed to make each bond. Such droplets are defined in size by the size of orifice 30 in combination with the supporting surface area in contact with the drop during develoment of the drop. These rather complex relationships necessarily dictate the cross-sectional area and length of passageway 22. Commensurately, these very same relationships make it possible for the passageway to be self-clearing with the use of cyanoacrylate and/or anaerobic adhesives.

To prevent leakage from dropper 12 during storage and handling of container 10, a cap 38, as shown in phantom in FIG. 2, may be employed. A plug 40 (shown in phantom) may extend from interior base 42 for penetrating engagement with passageway 22. On initial insertion of the plug within the passageway, it will initiate forced downward flow of any cyanoacrylate adhesive within the passageway. The initial downward flow, on comingling with any further cyanoacrylate adhesive in the passageway will, by means of what is believed to be an "avalanche" effect, initiate and maintain essentially complete drainage of the cyanoacrylate from the passageway back into the container. The plug would also serve the purpose of sealing the passageway against leakage.

To prevent possible damage to outlet 30 by repeated insertion and withdrawal of plug 40, the latter may be omitted. To obtain sealing of the outlet the length of nozzle 20 may be configured to place the end of the nozzle flush against base 42 to effect a seal across the outlet. A further seal intermediate the cap and neck 14 can be obtained by a close tolerance threaded relationship between ridge 44 about the neck and groove 46 within the cap.

While the principles of the invention have now been made clear in an illustrative embodiment, there will be immediately obvious to those skilled in the art many modifications of structure, arrangement, proportions, elements, materials, and components, used in the practice of the invention which are particularly adapted for sepcific environments and operating requirements without departing from those principles.

I claim:

1. A self-clearing dispenser for dispensing adhesives, which adhesives cure by polymerization, said dispenser comprising in combination:

(a) a necked container for housing the adhesive prior to dispensation;

(b) a nozzle of monolithic contruction having an annular flange defining an essentially planar surface from which surface depends a skirt and which skirt is press fitted into the neck of said container to effect a seal between said nozzle and said container;

(c) a boss depending from said planar surface into said container, said boss including a sharp edged perimeter;

(d) an inlet disposed in said boss and defined by a sharp edged orifice; and (e) an adhesive conveying passageway extending from said inlet through said nozzle, said passageway terminating at an outlet having a sharp edged orifice;

whereby, the configuration of structure attendant said inlet minimizes clogging of said inlet by the adhesive.

2. The dispenser as set forth in claim 1 wherein said passageway defines a volume sufficient to develop a drop of said cyanoacrylate at said inlet upon righting of said container too large to make sufficient surface contact with said inlet sharp edged orifice to permit depending support of the drop at said inlet by the forces attendant surface tension of the drop; whereby, said passageway and said inlet are self-clearing on righting of the container.

3. The dropper as set forth in claim 1 wherein said passageway is of constant diameter.

* * * * *